US006955630B2

(12) United States Patent
Sher

(10) Patent No.: US 6,955,630 B2
(45) Date of Patent: Oct. 18, 2005

(54) EXERCISE MACHINE

(75) Inventor: Mike Sher, Taipei (TW)

(73) Assignee: Zangzhou I Con Machinery Co., Ltd., Chang Chou (CN)

( * ) Notice: Subject to any disclaimer, the term of this patent is extended or adjusted under 35 U.S.C. 154(b) by 5 days.

(21) Appl. No.: 10/331,447

(22) Filed: Dec. 27, 2002

(65) Prior Publication Data

US 2004/0106502 A1 Jun. 3, 2004

(30) Foreign Application Priority Data

Dec. 2, 2002 (CN) ..... 02 2 77793 U

(51) Int. Cl.[7] ..... A63B 21/00
(52) U.S. Cl. ..... 482/8; 482/1; 482/9
(58) Field of Search ..... 482/1–9, 900–902

(56) References Cited

U.S. PATENT DOCUMENTS 4,768,777 A * 9/1988 Yang ..... 482/57
5,027,303 A * 6/1991 Witte ..... 702/44
5,050,865 A * 9/1991 Augspurger et al. ..... 482/2
5,071,117 A * 12/1991 Mautner et al. ..... 482/57
5,205,801 A * 4/1993 Haner ..... 482/63

* cited by examiner

*Primary Examiner*—Glenn E. Richman
(74) *Attorney, Agent, or Firm*—Charles E. Baxley

(57) ABSTRACT

An exercise machine includes a frame, a motor/generator mounted on the frame and switched between a motor mode and a generator mode, a control unit connected with the motor/generator for activating the motor/generator in the motor mode, and two cranks connected with the motor/generator, wherein the cranks are driven via the motor/generator in the motor mode and drive the motor/generator in the generator mode. In an aspect, the exercise machine includes two pedals each attached to one of the cranks. In another aspect, the exercise machine includes two cranes pivotally mounted on the frame and two skis each including an end pivotally connected with one of the cranes and an opposite end pivotally connected with one of the cranks.

4 Claims, 7 Drawing Sheets

EXERCISE MACHINE

BACKGROUND OF THE INVENTION

1. Field of Invention

The present invention relates to an exercise machine.

2. Related Prior Art

Taiwanese Patent Publication No. 186181 discloses an exercise machine including a base installed on the ground and a casing mounted on the base. The casing consists of two halves 11 and 12. A shaft 21 is rotationally mounted on the halves 11 and 12. Two cranks 41 are mounted on the shaft 21. Each of the cranks 41 is connected with a pedal 42. Treading of the pedals 42 causes rotation of the shaft 21. A wheel 22 is mounted on the shaft 21 so that they rotate together. A flywheel 42 is connected with the wheel 22 through a transmission 30. The rotation of the wheel 22 causes rotation of the flywheel 42. A magnet 23 is secured to the flywheel 42. The rotation of the flywheel 42 causes rotation of the magnet 23. A magnet 14 is pivotally mounted on the halves 11 and 12. The magnet 14 is in the form of an ark extending by and along the flywheel 42. The rotation of the magnet 23 relative to the magnet 14 exerts resistance thereon. The magnet 14 is separated from the flywheel 42 by a gap that can be adjusted through a cable 15 connected with the magnet 14. The adjustment of the gap causes adjustment of the resistance. This conventional exercise machine is, however, complicated in structure. Such a complicated structure entails a high cost in manufacturing and difficultly in maintenance. Furthermore, this exercise machine cannot be used for rehabilitation of a patient who cannot move his legs for himself.

The present invention is therefore intended to obviate or at least alleviate the problems encountered in prior art.

SUMMARY OF INVENTION

It is the primary objective of the present invention to provide an exercise machine equipped with an instrument 40 that does not required a card for operation.

According to the present invention, an exercise machine includes a frame, a motor/generator mounted on the frame and switched between a motor mode and a generator mode, a control unit connected with the motor/generator for activating the motor/generator in the motor mode, and two cranks connected with the motor/generator, wherein the cranks are driven via the motor/generator in the motor mode and drive the motor/generator in the generator mode.

In an aspect, the exercise machine includes two pedals each attached to one of the cranks.

In another aspect, the exercise machine includes two cranes pivotally mounted on the frame and two skis each including an end pivotally connected with one of the cranes and an opposite end pivotally connected with one of the cranks.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF PREFERRED EMBODIMENT

Figure 1:
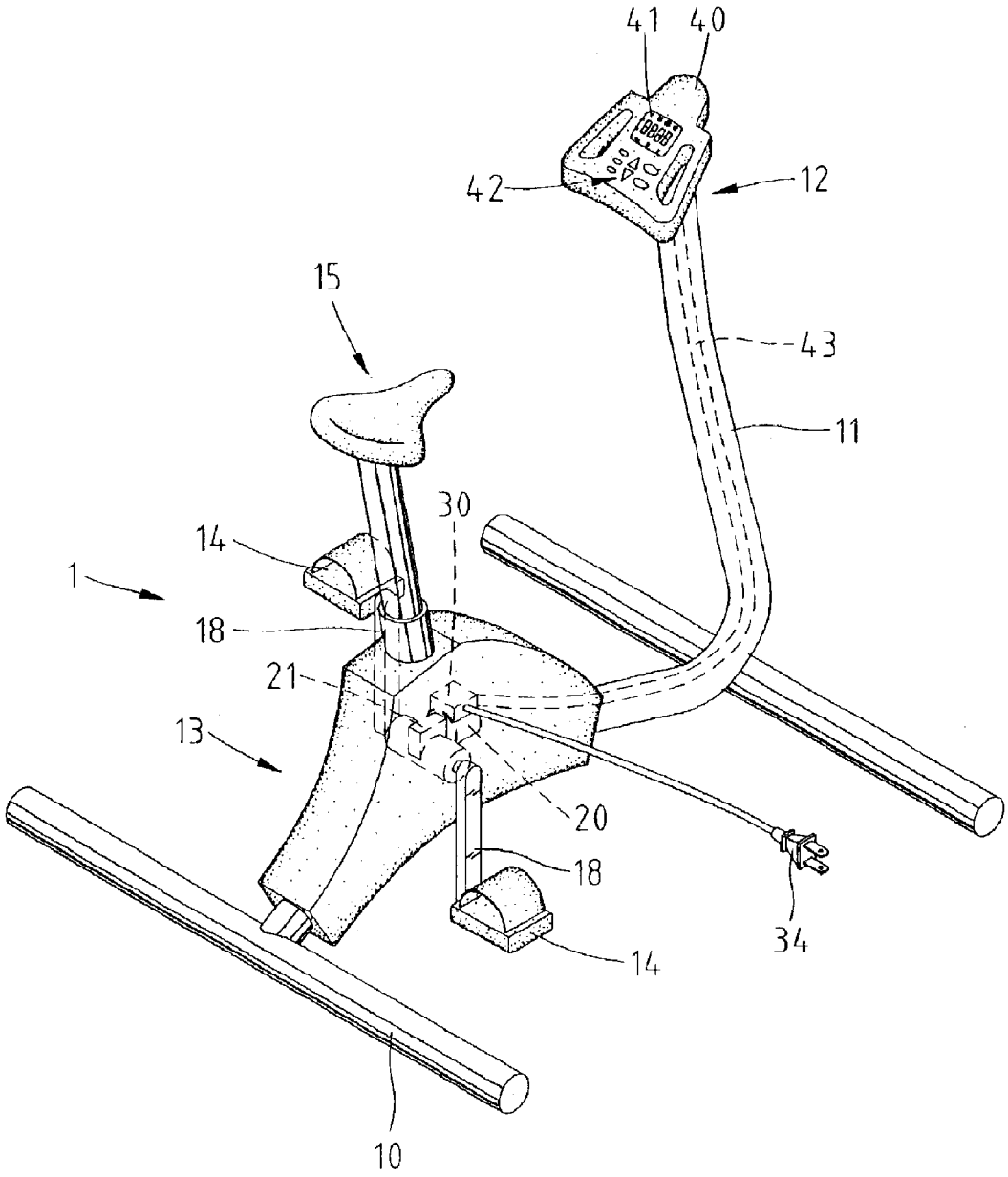
FIG. 1 is a perspective view of an exercise machine including a motor/generator and an instrument 40 according to an embodiment of the present invention.

Referring to FIG. 1, according to an embodiment of the present invention, an exercise machine 1 is in the form of a bike. The exercise bike 1 includes a frame including two cross bars 10, a keel 11 mounted on the cross bars 10 and a post (not numbered). A seat 15 is mounted on the post. An instrument 40 is mounted on an upstanding section of the keel 36. A motor/generator 20 is mounted on the keel 11. Two pedals 14 are attached to two cranks 46 connected with the motor/generator 20. The motor/generator 20 can be switched between modes: motor mode and generator mode. In the motor mode, the motor/generator 20 can drive the pedals 14. In the generator mode, the motor/generator 20 can be driven via the pedals 14. Moreover, the motor/generator 20 provides several gears. A control unit 30 is connected with the motor/generator 20. The control unit 30 is communicated with the instrument 40 through a cable 43. The motor/generator 20 and the control unit 30 are concealed in a shell 42 mounted on the keel 11.

Figure 3:
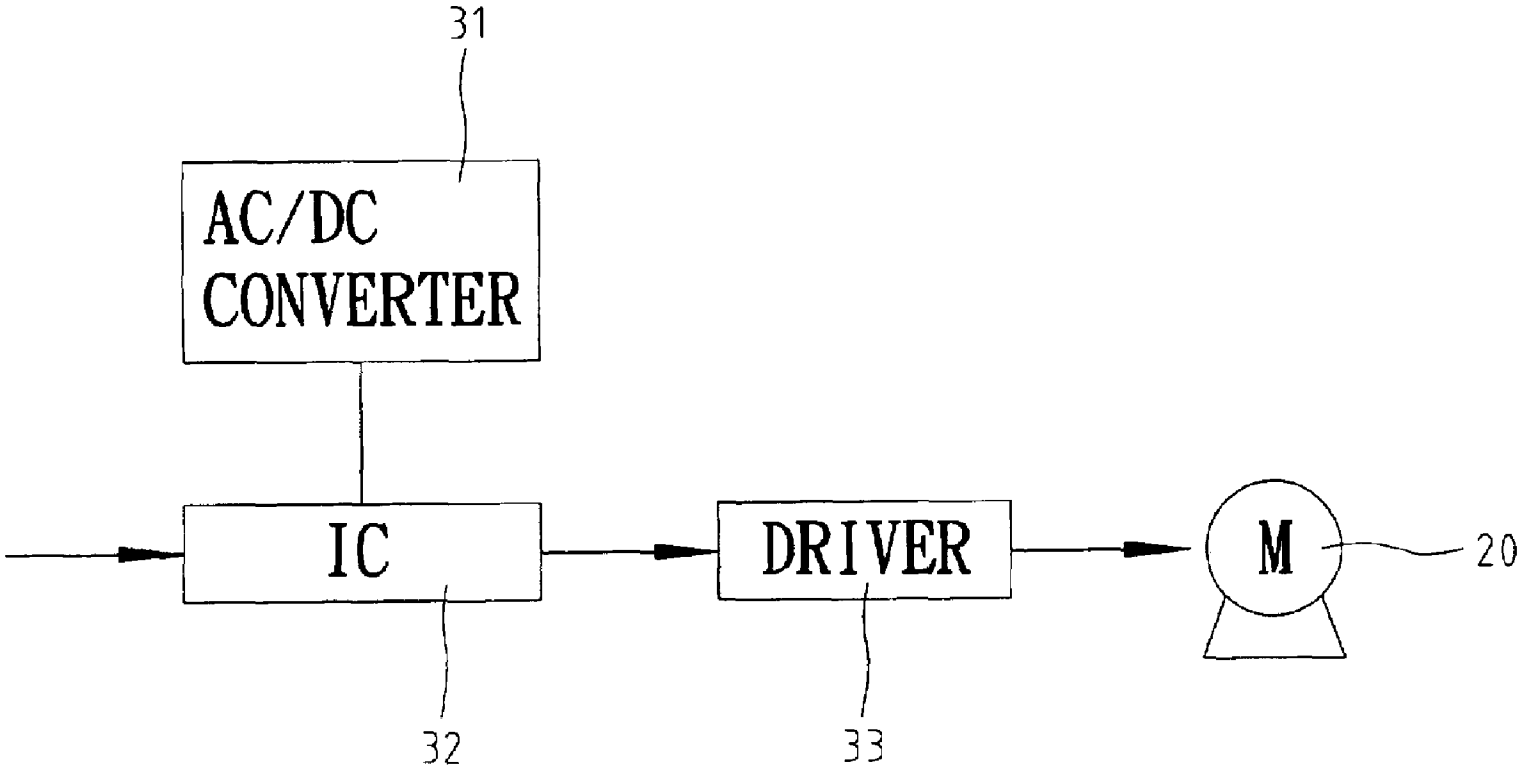
FIG. 3 is a block diagram of a circuit used for control over the motor/generator shown in FIG. 2.
Figures 4, 5, 6:
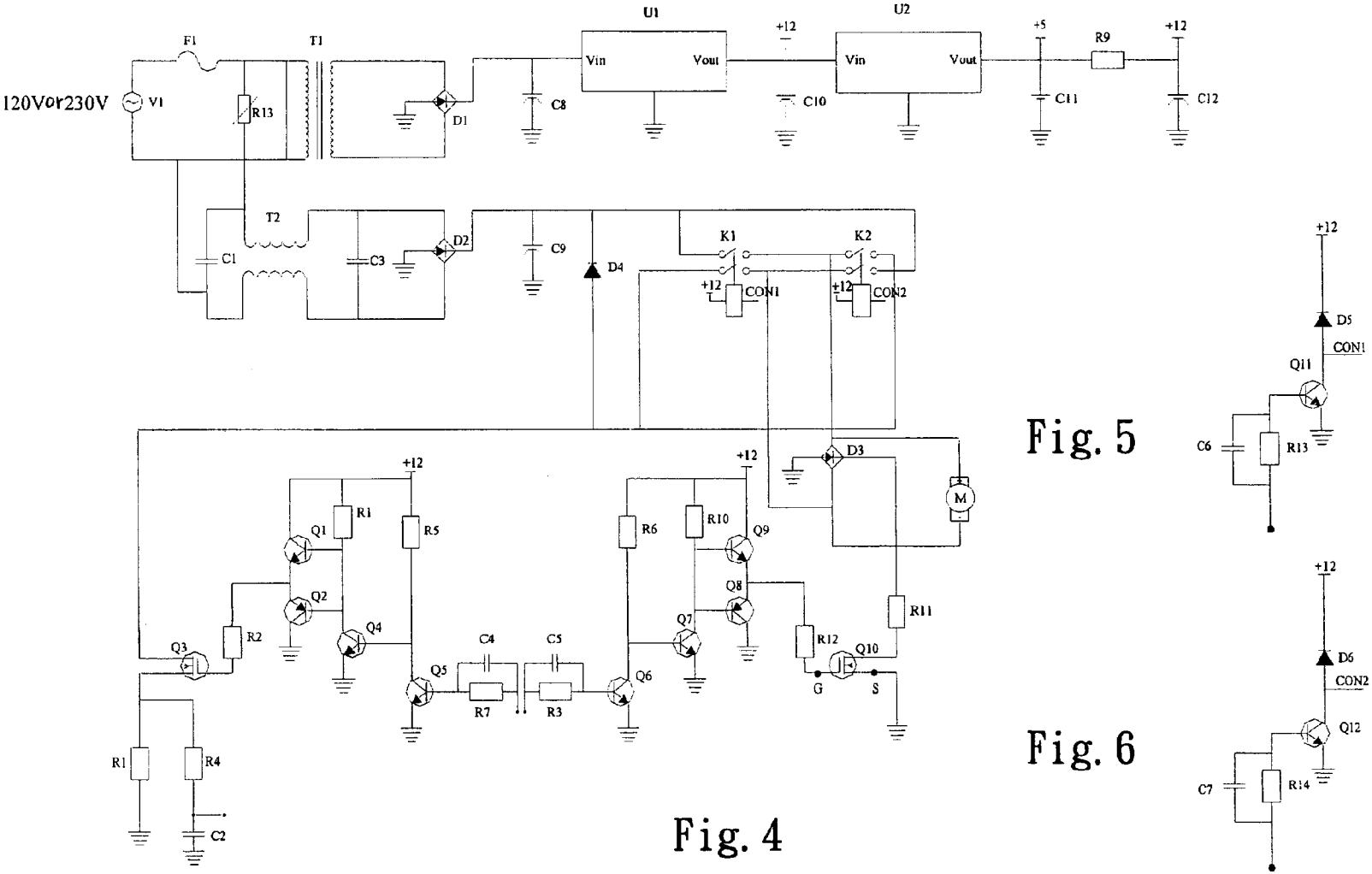
FIG. 4 shows a layout of the circuit shown in FIG. 3.
FIG. 5 shows a portion of the circuit shown in FIG. 4.
FIG. 6 shows a portion of the circuit shown in FIG. 4.
Figure 7:
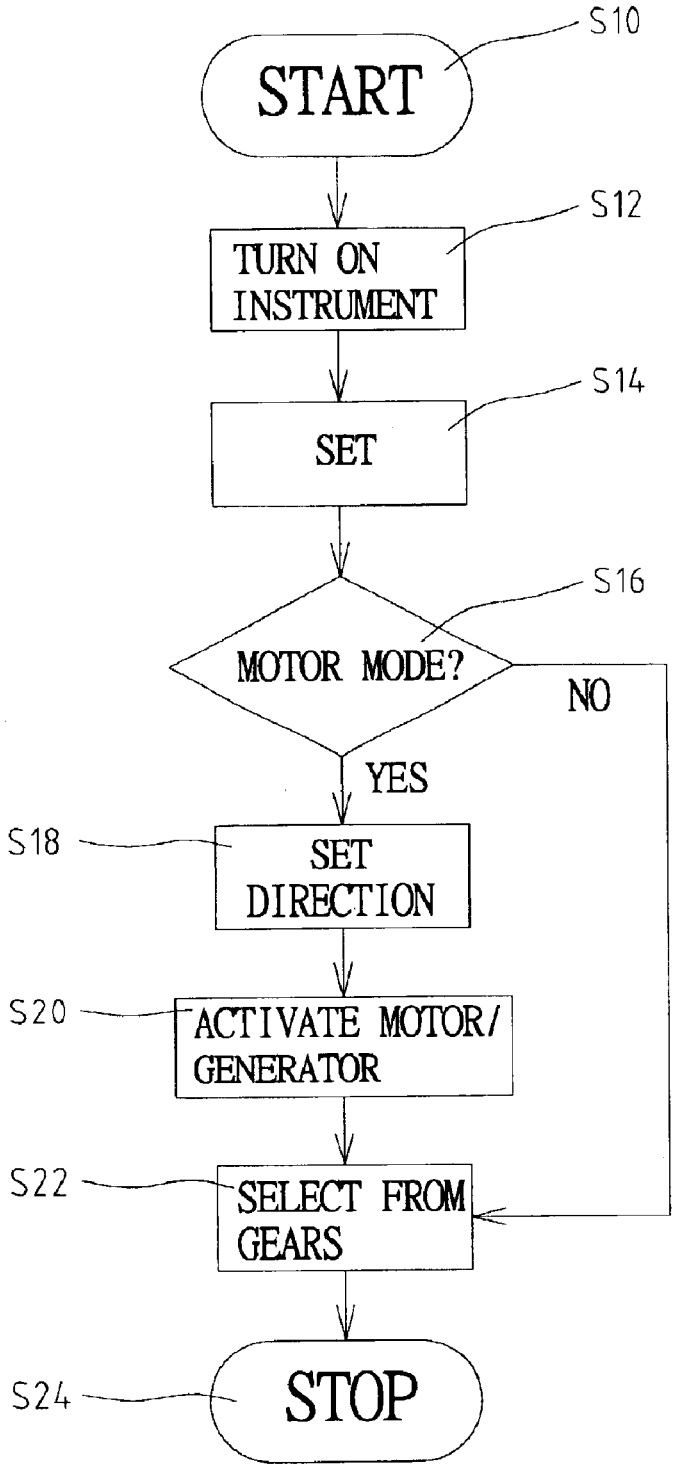
FIG. 7 is a flow chart of the operation of the exercise machine of FIG. 1.

Referring to FIGS. 3 and 4, the control unit 30 includes an AC/DC converter 31, an integrated circuit 32 ("IC 32") connected with the AC/DC converter 31 and a driving circuit 33 connected with the integrated circuit 32. A plug 34 is connected with the AC/DC converter 31 through a cable (not numbered). The plug 34 can be engaged with a socket (not shown) of a mains power system for transmitting alternative circuit ("AC") to the AC/DC converter 31. The AC/DC converter 31 is used to convert the AC to direct circuit ("DC"). The AC/DC converter 31 may include two transformers T1 and T2 and two rectifiers D1 and D2. The IC 32 is used to process and provide different control signals to the driver 33 for switching the motor/generator 20 between the modes.

Figure 2:
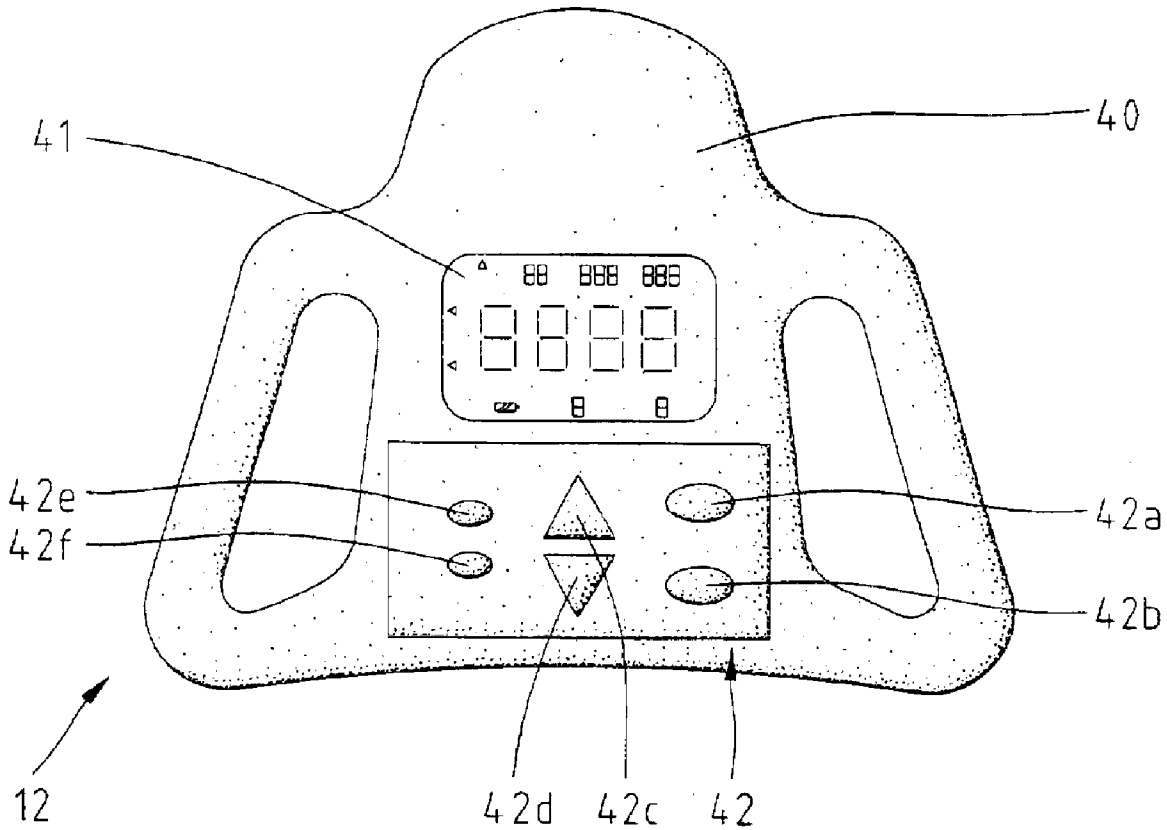
FIG. 2 is a front view of the instrument 40 of FIG. 1.

Referring to FIG. 2, the instrument 40 includes a casing (not numbered) mounted on the upstanding section of the keel 11, two handles 12 extending from the casing, a display 41 mounted on the casing, a control panel 42 mounted on the casing 10 and an integrated circuit (not shown) connected with the control panel 42 and received in the casing 10. The display 41 is used to display information regarding the exercise machine and values regarding workout intended for a user. The control panel 42 includes a START/STOP button 42*a*, a SET button 42*b*, an UP button 42*c*, a DOWN button 42*d*, a direction button 42*e* and a MANUAL/AUTOMATIC button 42*f*.

FIG. 5 shows a flowchart of the operation of the control unit 30 according to the first embodiment of the present invention.

In step S10, the user turns on the instrument 40 and starts the process via pushing the START/STOP button 42*a*.

In step S12, the IC of the instrument 40 instructs the display 41 to show an indication for the user to select from several parameters that he or she wants to set. The user enters selects via pushing the SET button 42*b*.

In step S14, the IC module 20 checks whether the user code has been recorded. The process goes to step 58 if it has never been entered and goes to step 62 if otherwise.

In step S16, the IC of the instrument 40 instructs the display 41 to display an indication for the user to select from a manual mode and an automatic mode. The user selects via pushing the MANUAL/AUTOMATIC button 42*f*. If the user selects the automatic mode, the process goes to step S18 and to step S22 if otherwise.

In step S18, the IC of the instrument 40 instructs the display 41 to display an indication for the user to select from two rotational directions of the motor 42, i.e., a forward direction and a backward direction. The user selects via pushing the direction button 42*f*.

In the case that the forward direction is selected, a first signal is sent from the instrument 40 to the control unit 30. The IC 32 sends a first control signal to the driver 33. Referring to FIG. 5, this first control signal turns on a relay CON1 and switch K1. A positive voltage is provided to the driver 33 in order to drive the motor/generator 20 in the forward direction.

In the case that the backward direction is selected, a second signal is sent from the instrument 40 to the control unit 30. The IC 32 sends a second control signal to the driver 33. Referring to FIG. 6, this second control signal turns on a relay CON2 and switch K2. A negative voltage is sent to the driver 33 so as to drive the motor/generator 20 in the forward direction. From step S18, the process goes to step S20.

In step S20, the IC of the instrument 40 instructs the display 41 to display an indication for the user to send a signal to the motor/generator 20. The user sends a signal to the motor/generator 20 via pushing the START/STOP button 42*a*. On receiving the signal, the motor/generator 20 starts to act as a motor so as to drive the pedals 14. For safety of the user, the motor/generator 20 is pre-set to start at the first gear. Then, the process goes to step S24.

In the manual mode, the motor/generator 20 is not actuated as a motor. When the user treads the pedals 14, the motor/generator 20 exerts resistance on the pedals 14, and acts as a generator to generate a voltage that is transmitted to an element Q10 through a rectifier D3. The resistance exerted is detected and processed by means of the control unit 30. The control unit 30 sends a signal to the instrument 40. On receiving the signal, the instrument 40 instructs the display 41 to show the workout of the user. A user can adjust the resistance via adjusting a circuit flowing through the element Q10. The resistance exerted on the pedals 14 is proportional to a current flowing through the element Q10.

In step S22, the IC module instructs the user to select from several gears. The user selects from the gears via pushing the UP button 42*c* and the DOWN button 42*d*.

In step S24, the user turns off the instrument 40 via pushing the START/STOP button 42*a*.

Figure 8:
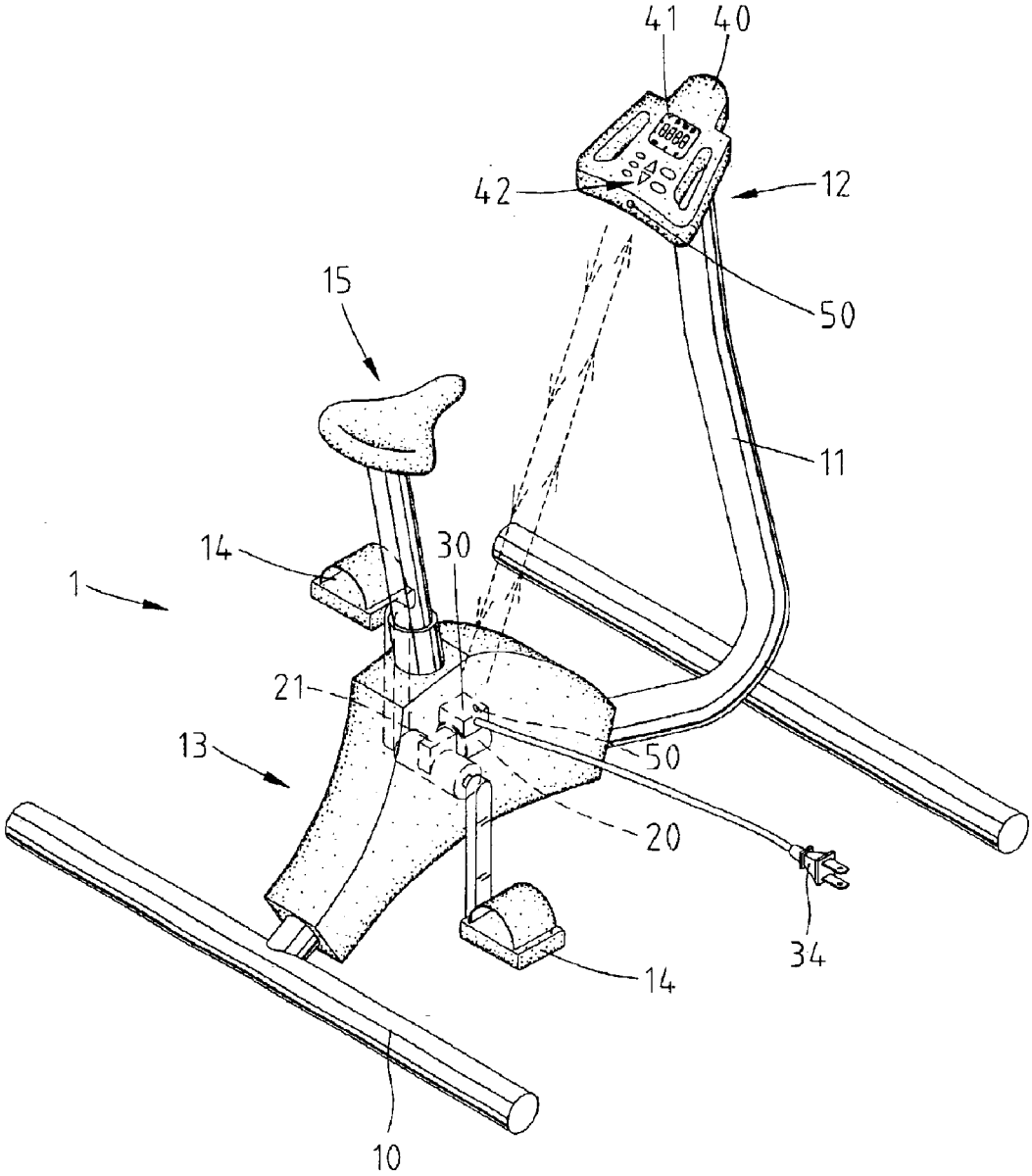
FIG. 8 is a perspective view of an exercise machine including a motor/generator and an instrument 40 according to a second embodiment of the present invention.

FIG. 8 shows an exercise machine according to a second embodiment of the present invention. The second embodiment is different from the first embodiment in that the communication between the control unit 30 and the instrument 40 is wireless instead of through a cable. To this end, the control unit 30 includes a transceiver 50, and the instrument 40 includes a transceiver 50.

Figure 9:
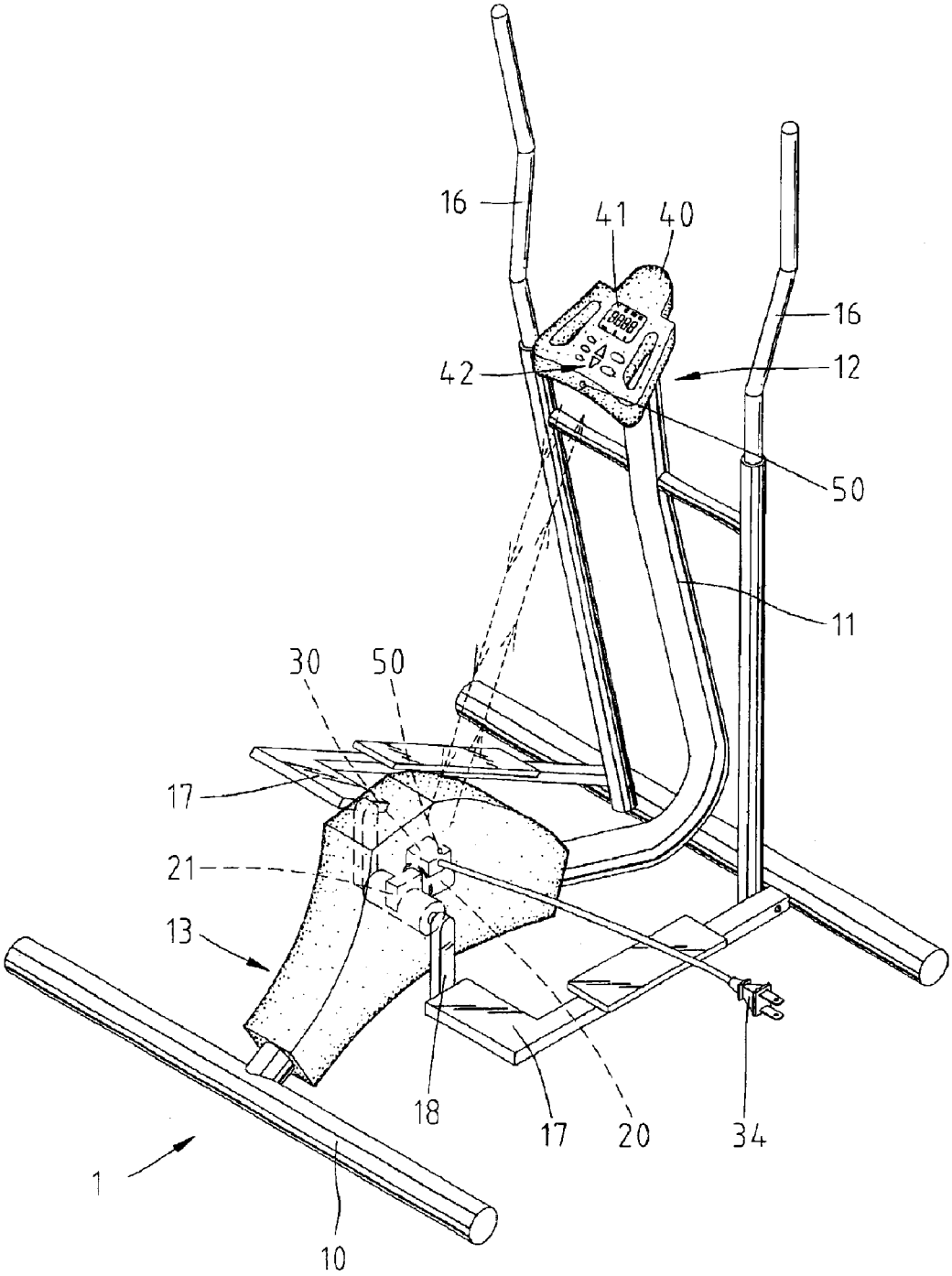
FIG. 9 is a perspective view of an exercise machine including a motor/generator and an instrument 40 according to a third embodiment of the present invention.

FIG. 9 shows an exercise machine according to a third embodiment of the present invention. The third embodiment is different from the first embodiment in that two cranes 16 are pivotally mounted on the upstanding section of the keel 11 and that two skis 17 are used instead of the pedals 14. Each of the skis 17 includes an end pivotally connected with one of the cranes 16 and another end pivotally connected with one of the cranks 18.

The present invention has been described via illustration of some embodiments. The applicant gives these embodiments only as examples, and those skilled in the art can derive variations from the embodiments. Therefore, these embodiments shall not limit the scope of the present invention that is defined in the claims.

What is claimed is:

1. An exercise machine incline:

a frame;

a motor/generator mounted on the frame and switched between a motor mode and a generator mode;

a control unit connected with the motor/generator for activating the motor/generator in the motor mode; and two cranks connected with the motor/generator, wherein the cranks are driven via the motor/generator in the motor mode and drive the motor/generator in the generator mode wherein the control unit includes an AC/DC converter, an IC connected with the AC/DC converter and a driver connected with the IC.

2. An exercise machine including:

a frame;

a motor/generator mounted on the frame and switched between a motor mode and a generator mode;

a control unit connected with the motor/generator for activating the motor/generator in the motor mode; and two cranks connected with the motor/generator, wherein the cranks are driven via the motor/generator in the motor mode and drive the motor/generator in the generator mode, wherein the motor/generator can rotate in a first direction and a second direction opposite to the first direction, and wherein the control unit includes a first switch (K1), a first relay (CON1) for turning on the first relay (K1) so as to provide a positive voltage to the motor/generator for rotation in the first direction, a second switch (K2) and a second relay (CON2) for turning on the second switch (K2) so as to provide a negative voltage to the motor/generator for rotation in the second direction.

3. An exercise machine including:

a frame;

a motor/generator mounted on the frame and switched between a motor mode and a generator mode;

a control unit connected with the motor/generator for activating the motor/generator in the motor mode; and two cranks connected with the motor/generator, wherein the cranks are driven via the motor/generator in the motor mode and drive the motor/generator in the generator mode, wherein the motor/generator can rotate in a first direction and a second direction opposite to the first direction, and wherein the control unit includes an AC/DC converter, an IC connected with the AC/DC converter and a driver connected with the IC.

4. The exercise machine according to claim 3 wherein the driver includes a first switch (K1), a first relay (CON1) for turning on the first relay (K1) so as to provide a positive voltage to the motor/generator for rotation in the first direction, a second switch (K2) and a second relay (CON2) for turning on the second switch (K2) so as to provide a negative voltage to the motor/generator for rotation in the second direction.

* * * * *